US005947186A

United States Patent [19]

Pavlicevic et al.

[11] Patent Number: 5,947,186

[45] Date of Patent: Sep. 7, 1999

[54] METHOD TO OBTAIN VIBRATIONS IN THE WALLS OF THE CRYSTALLIZER OF AN INGOT MOULD BY MEANS OF ACTUATORS AND THE RELATIVE DEVICE

[75] Inventors: Milorad Pavlicevic; Nuredin Kapaj, both of Udine; Alfredo Poloni, Fogliano di Redipuglia; Andrea De Luca, Remanzacco, all of Italy

[73] Assignee: Danieli & C. Officine Meccaniche SpA, Buttrio, Italy

[21] Appl. No.: 08/936,625

[22] Filed: Sep. 24, 1997

[30] Foreign Application Priority Data

Sep. 25, 1996 [IT] Italy ..... UD96A0180

[51] Int. Cl.[6] ..... B22D 11/04

[52] U.S. Cl. ..... 164/478; 164/416

[58] Field of Search ..... 164/478, 416, 164/71.1, 260

[56] References Cited

U.S. PATENT DOCUMENTS

| | | | |
|---|---|---|---|
| 4,662,427 | 5/1987 | Larrecg et al. | 164/416 |
| 4,867,226 | 9/1989 | Uehara et al. | 164/478 |
| 5,355,935 | 10/1994 | Nogues | 164/416 |
| 5,739,724 | 4/1998 | Alexandre et al. | 331/18 |

FOREIGN PATENT DOCUMENTS

| | | | |
|---|---|---|---|
| 536317 | 9/1955 | Belgium . | |
| 0042007 | 12/1981 | European Pat. Off. . | |
| 0372506 | 6/1990 | European Pat. Off. . | |
| 59-199147 | 11/1984 | Japan | 164/416 |
| 60-99453 | 6/1985 | Japan | 164/416 |
| 417229 | 7/1974 | U.S.S.R. | 164/416 |

OTHER PUBLICATIONS

Database WPI, Section CH, week 8713, Derwent Publications Ltd., London, GB; Class M22, AN 87—091676 XP002028738 & SU 363 298 (Surin E V) Aug. 23, 1986.

Database WPI, Section CH, Week 7502, Derwent Publications Ltd., London, GB; Class M22, AN 75–03193W XP02028739 & SU 417 229 A (Ferr Metallurg Bardin IN) Jul. 23, 1974.

*Primary Examiner*—Harold Pyon
*Assistant Examiner*—I.-H. Lin
*Attorney, Agent, or Firm*—Antonelli, Terry, Stout & Kraus, LLP

[57] ABSTRACT

Method and device to obtain vibrations in the walls of the crystalliser (11) in an ingot mould (10) by use of actuators, the ingot mould (10) including a channel use (13) for the circulation of cooling liquid, the ingot mould (10) being associated with a conventional system of oscillation, there being induced on the crystalliser (11) vibrations of small amplitude and high frequency and acceleration obtained by exciting an actuator (16) comprising an element in magnetostrictive alloy (18) arranged in cooperation with at least one face of the crystalliser (11) itself, the element in magnetostrictive alloy (18) being excited by an electromagnetic field.

18 Claims, 4 Drawing Sheets

METHOD TO OBTAIN VIBRATIONS IN THE WALLS OF THE CRYSTALLIZER OF AN INGOT MOULD BY MEANS OF ACTUATORS AND THE RELATIVE DEVICE

BACKGROUND OF THE INVENTION

This invention concerns a method to obtain vibrations in the walls of the crystalliser of an ingot mould by means of actuators, and also the relative device.

The invention is applied in the field of continuous casting of billets, blooms or slabs of any type or section, in order to reduce friction between the cast product and the walls of the crystalliser, thus allowing the casting speed to be increased and reducing the risk of break-out in the skin of the product being formed.

The crystallisers to which the invention can be applied are those which have a thick wall, or a medium wall or a thin wall, and also those for slabs with short, movable walls so as to vary the width of the slab.

The state of the art covers attempts to reduce the force required to extract the cast product from inside the crystalliser, and the problems connected thereto.

For it is well-known that the skin as it solidifies, at least in the upper part of the crystalliser, tends to stick to the walls, generating considerable friction during the extraction step.

In order to facilitate the separation of the skin from the walls, the state of the art includes generating vertical, mechanical oscillations on the ingot mould which facilitate the extraction of the product and thus make it possible to increase the casting speed and improve the surface quality of the product leaving the crystalliser.

It is also well-known that in the lower part of the crystalliser the skin, which has by now already solidified, tends to separate from the walls, creating an air gap which causes a reduction in the heat exchange between the cooled wall and the solidified skin and therefore a reduction in the flow of heat removed from the molten metal through the wall of the crystalliser.

The present applicants, in their application for a European patent EP-A-0686445, described the use of a crystalliser with thin walls associated with a method to control the deformations of the walls; in this invention, the pressure of the cooling fluid flowing in the transit channel adjacent to the said walls is regulated to compensate for the different shrinkage of the skin of the cast product along the crystalliser according to the type of steel and the casting speed.

According to this document, the walls of the crystalliser take on an elastic quality depending on the different pressures of the cooling liquid flowing inside them, in such a way that, in the first segment of the crystalliser, the negative taper induced by the thermal field is cancelled, and, in the lower part of the crystalliser, the air gap created between the solidified skin and the walls is minimised.

These pressures are calculated in such a way as to obtain the desired deformation of the walls and are maintained substantially constant until the casting parameters are changed, particularly the type of steel and the casting speed.

SUMMARY OF THE INVENTION

The present applicants, with this invention, have set themselves the aim of obtaining a solution which can be applied substantially to any kind of crystalliser, which will provide advantages by reducing the force required to extract the product, reducing the sticking between skin and walls, reducing the force of friction between the wall of the crystalliser and the cast product and also increasing the surface quality and other advantages; for this purpose the present applicants have designed, tested and embodied this invention.

The purpose of the invention is to provide a method to obtain desired vibrations in the specific walls of the crystalliser by means of actuators, vibrations which will make it possible to reduce the friction between the wall of the crystalliser and the cast product and consequently will make it possible to reduce the force required to extract the cast product from the crystalliser.

A further purpose of the invention is to obtain a consequent increase in the surface quality of the cast product thus obtained.

Moreover, the invention encourages the separation of the metal in the upper part of the crystalliser, reducing the friction due to sticking and also reducing the risk of deteriorations in the surface of the cast product due to its scraping along the walls.

According to the invention, in cooperation with at least one of the walls of the crystalliser there are magnetostrictive actuators suitable to generate desired vibrations of small amplitude and high frequency and acceleration on the walls with which they are associated.

The characteristics of frequency, acceleration and amplitude of the vibrations induced are such that they assist the continuous detachment of the skin of the cast product from the wall of the crystalliser as soon as the skin begins to stick to the wall.

Magnetostrictive materials have the property that they are able to undergo transitory mechanical deformations if subjected to a magnetic field, or to produce a magnetic field if they are subjected to mechanical deformation. In other words, these magnetostrictive materials represent in the magnetic field what piezoelectric materials represent in the electric field.

Thus the magnetostrictive alloy can be used efficiently to achieve actuators with much higher performance than actuators which use piezoelectric materials.

In particular, these actuators respond very quickly to stimuli, they possess a high energy density and low losses, they are activated with low working tensions and have high resistivity.

A typical application of magnetostrictive actuators used in applications of the invention is to obtain a force produced between 4 and 30 kN in a range of frequencies of between 0.1 and 20 kHz with a maximum acceleration of 3000 g and a maximum displacement of about 0.20 mm for a maximum feed current of about 145 A. Moreover, the size of these actuators is extremely small.

The magnetostrictive actuators work on the principle that a rod made of a magnetostrictive alloy placed in contact, directly or by means of an intermediate pusher element, with the wall of the crystalliser and subjected to a magnetic field, is mechanically deformed and thus induces a vibration in the wall itself.

The walls of the crystalliser can be made to vibrate by means of these actuators in a plurality of different ways.

One method is to apply a transverse excitation by means of the actuators, exploiting the elastic properties of the crystalliser, which is left free to vibrate.

According to the shape of the segment of the crystalliser, the distribution of the actuators may be: one actuator for every wall or face of the crystalliser, or two actuators associated with opposite faces of the crystalliser.

According to a variant, there are groups of actuators arranged along the axis of the crystalliser, and each group cooperating with one face thereof, in order to distribute the effect over the whole length of the crystalliser.

According to this solution, the excitation of the walls of the crystalliser is achieved by inducing vibrations which are coherent with the crystalliser's own frequencies. According to a variant, the excitation of the walls of the crystalliser is achieved by inducing vibrations which are not coherent with the crystalliser's own frequencies.

The solution of exciting the crystalliser's own frequencies is advantageous from the point of view of saving energy, in that a small quantity of energy is sufficient to obtain a considerable vibration effect. Moreover, from the mechanical point of view, it is possible to determine the characteristics of deformation associated with the crystalliser's own frequencies which best satisfy the needs of vibration.

In this case, it is possible to select the individual frequencies, or their linear combinations, which possess nodes and antinodes in fixed positions and advantageous for the casting process.

According to this embodiment, it is also possible to excite the crystalliser with a series of its own frequencies in such a way that the nodes and antinodes do not remain fixed for a period of time but create a migrating effect along the crystalliser.

According to the invention, the number and position of the actuators along the crystalliser is determined by the type and number of the crystalliser's own frequencies which are to be excited.

According to a variant, there is a computerised system of monitoring and retroactive intervention to obtain the induced vibration at the desired frequencies.

The variant in which the crystalliser's own frequencies are not induced can be used when it is necessary to obtain a localised vibration in the crystalliser, for example when it is necessary to excite only the upper part of the crystalliser where the sticking of the cast product to the wall of the crystalliser is greater.

According to this embodiment, the range of frequencies which can be used is between about 0.1 and about 20 KHz, while the maximum amplitude of the vibrations is about 0.20 mm.

In a second embodiment of the invention, the magnetostrictive actuators are arranged in such a way as to induce a transverse vibration in the crystalliser which is restrained at the sides by elastic supports.

In this embodiment, the crystalliser is anchored to the outer wall of the ingot mould by means of elastic supports which allow a rigid movement in one of the two directions transverse to the vertical and perpendicular to the wall of the crystalliser itself.

By using one or more magnetostrictive actuators suitably arranged in contact with the wall of the crystalliser and transverse thereto, it is possible to induce transverse vibrations on the crystalliser in such a way as to make it oscillate like a rigid body.

This solution has the advantage from the mechanical point of view that it does not stress the structure of the crystalliser directly, but discharges at least part of the stresses to the suitably chosen elastic system.

In this case, the range of frequencies which can be used is between about 0.1 and about 20 kHz, while the maximum amplitude of the vibrations is about 0.08 mm.

According to a further embodiment of the invention, the magnetostrictive actuators are arranged in such a way as to induce on the crystalliser a vertical vibration which is superimposed on the oscillations induced in a manner known to the state of the art in the ingot moulds which contain the crystalliser.

In this case, the magnetostrictive actuators constitute a system which causes a vertical oscillation of the crystalliser itself with respect to the ingot mould, which in turn is oscillating vertically in a known manner.

The vertical oscillation induced on the crystalliser by the magnetostrictive actuators has high frequency parameters, for example between about 1 and about 20 kHz, with an extremely small amplitude, of about 0.03 mm maximum.

Considering the ingot mould-crystalliser system as a whole, high frequency and low amplitude oscillation is obtained in this case, which is caused by the direct action of the magnetostrictive actuators on the crystalliser, modulated to low frequency, up to about 5 Hz, by the main oscillation of high amplitude, up to 6 mm, generated on the ingot mould.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1B:
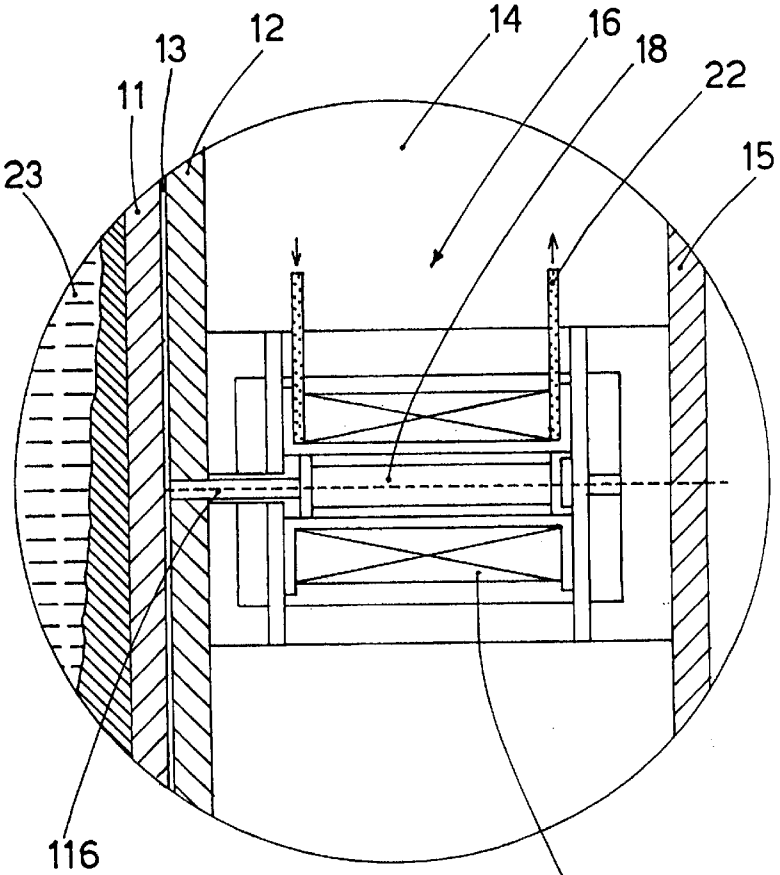
FIG. 1*b* shows the enlarged detail A of FIG. 1*a;*

The ingot mould 10 shown in FIG. 1 comprises a crystalliser 11 inside of which the molten metal 23 is cast by means of a nozzle 24 located below the meniscus 25.

As we have already said, the crystalliser 11 can have stationary or movable walls, and the walls can be of normal thickness or of thin thickness.

Hereinafter the invention is shown using a crystalliser with stationary walls, but the invention can easily be transferred to a crystalliser with movable walls.

In this case, the ingot mould 10 includes intermediate walls 12 arranged outside the crystalliser 11 and defining with it the channel 13 where the cooling liquid flows.

The intermediate wall 12 can be movable at right angles to the crystalliser 11 so as to achieve a transit channel 13 with a variable cross-section according to the cooling parameters desired.

The channel 13 is connected to an inlet 17*a* and an outlet 17*b* for the cooling liquid and cooperates, outside the intermediate wall 12, with a chamber 14 to introduce/discharge the liquid defined by an outer wall 15.

In this case, in cooperation with at least one face of the crystalliser 11 there is a magnetostrictive actuator 16 including at least a pusher element 116 located substantially in contact with the face of the crystalliser 11.

The pusher element 116 is placed in contact with the wall of the crystalliser 11 by passing through an aperture made at least in the intermediate wall 12 and its rear part is anchored, in this case, to the outer wall 15.

According to a variant the magnetostrictive actuator 16 is positioned outside the outer wall 15 and the pusher element 116 passes through the walls 15 and 12.

Figure 2:
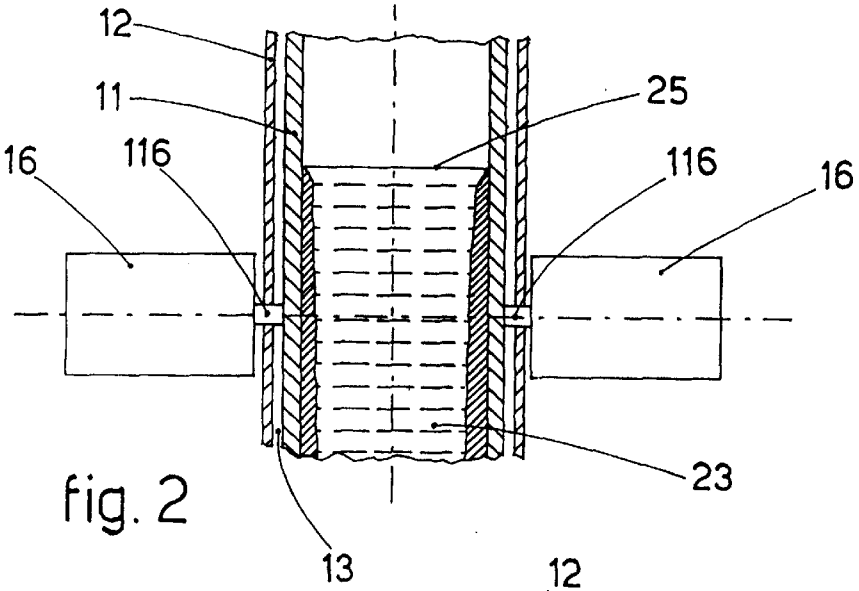
FIG. 2 shows one embodiment of the invention in diagram form and partly in lengthwise section.
Figure 3:
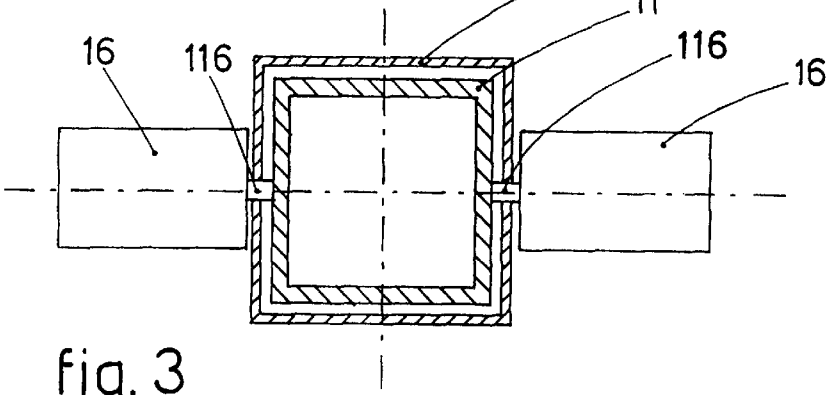
FIG. 3 shows the embodiment of FIG. 2 in a transverse section.
Figure 6:
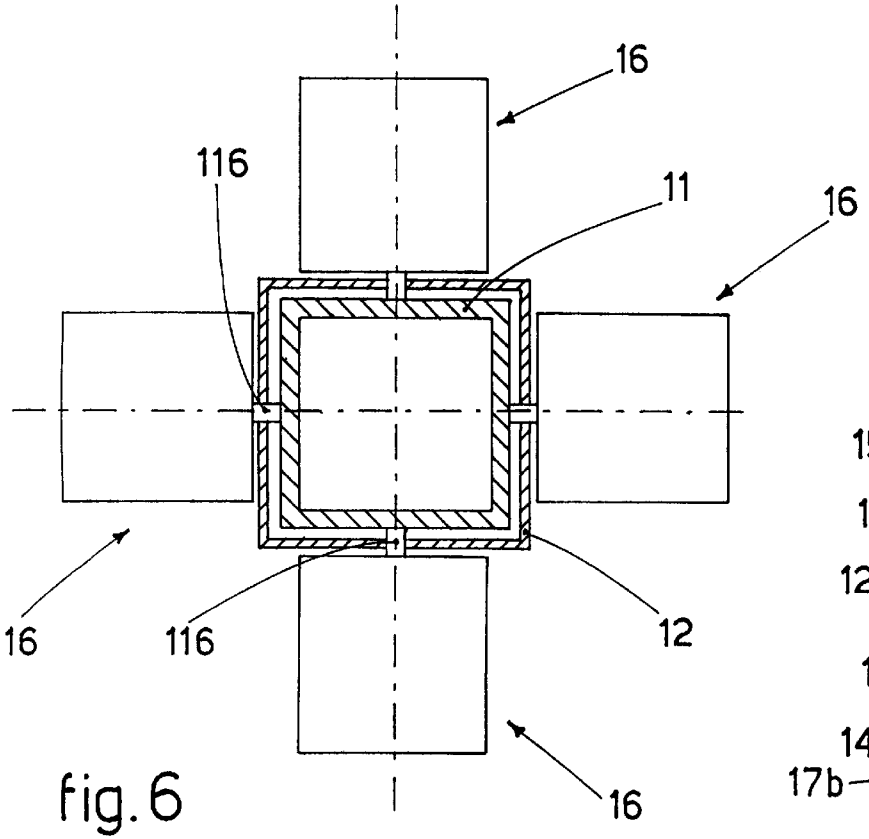

In the embodiment shown in FIGS. 2 and 3, there is a magnetostrictive actuator 16 in correspondence with two opposite faces of the crystalliser 11, while in the embodiment shown in FIG. 6 there are magnetostrictive actuators 16 in cooperation with all four faces of the crystalliser 11.

Figure 7:
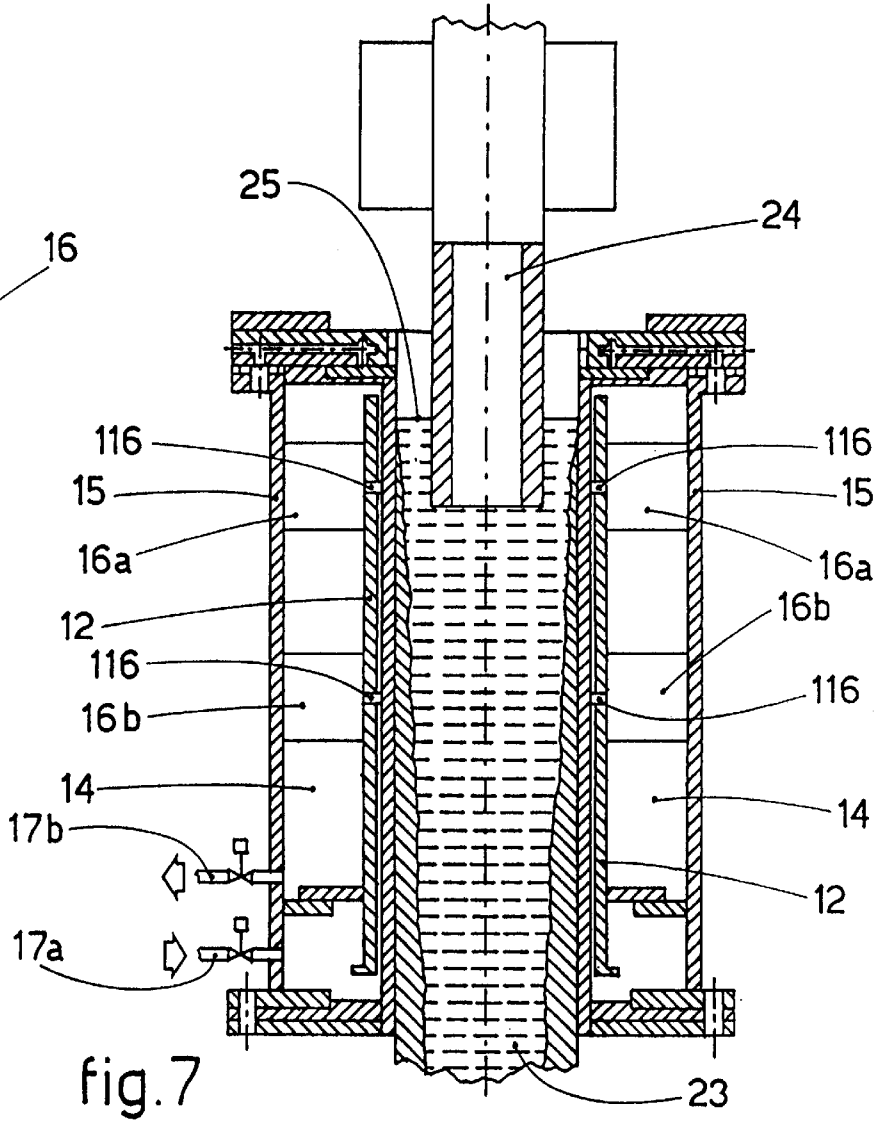
FIGS. 6 and 7 show partly and in diagram form two further embodiments of the invention.

The embodiment shown in FIG. 7 includes several magnetostrictive actuators, in this case 16*a* and 16*b*, at different heights along the length of the crystalliser 11 in order to distribute their effect over a vast area of the crystalliser 11, possibly with different functional parameters according to the different behaviour of the cast product at different heights of the crystalliser 11.

Figure 1A:
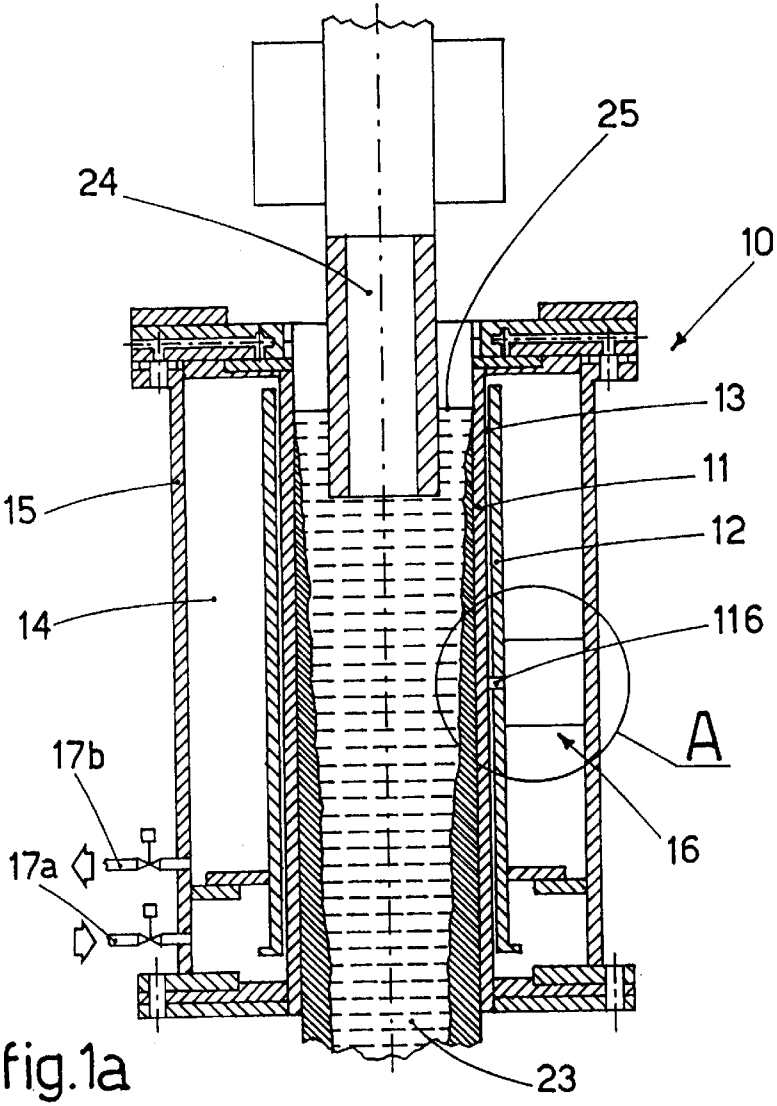
FIG. 1*a* shows a lengthwise partial section in diagram form of an ingot mould where the method to obtain vibrations according to the invention is applied.

The magnetostrictive actuator 16 is composed, in the case shown in FIG. 1*b*, of a rod 18 of magnetostrictive alloy arranged coaxially to the pusher element 116, around which there is a coil 19 which, when it is activated by the current passing through, is suitable to induce a magnetic field.

When activated, according to the working parameters, this magnetic field causes controlled mechanical deformations of the magnetostrictive rod 18 such as generate, through the pusher element 116, a consequent vibration in the wall of the crystalliser 11.

The magnetostrictive actuator 16 also comprises a cooling circuit with water 22 to cool the coils 19 during the operating cycle.

According to the embodiment shown in FIGS. 1*a*, 1*b*, 2, 3, 6 and 7, vibrations are induced on the crystalliser 11 in a transverse direction to exploit the elastic properties thereof, as the crystalliser 11 itself is free to oscillate.

These vibrations, acting on the feeding parameters of the coils 19, on the size of the magnetostrictive rod 18, on the length of the pusher element 116 and on other parameters, can be obtained, according to necessity, by exciting the own frequencies of vibration of the crystalliser 11, or by not exciting these frequencies.

Figure 4B:
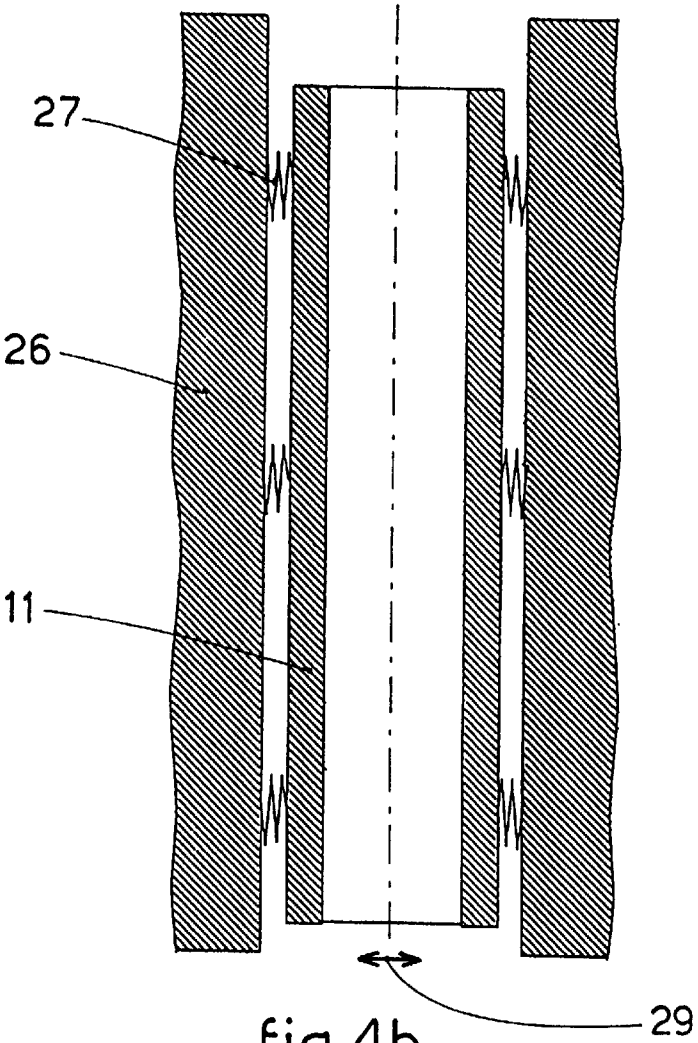
FIGS. 4*a* and 4*b* show, in two embodiments, a variant of the invention.
Figure 4A:
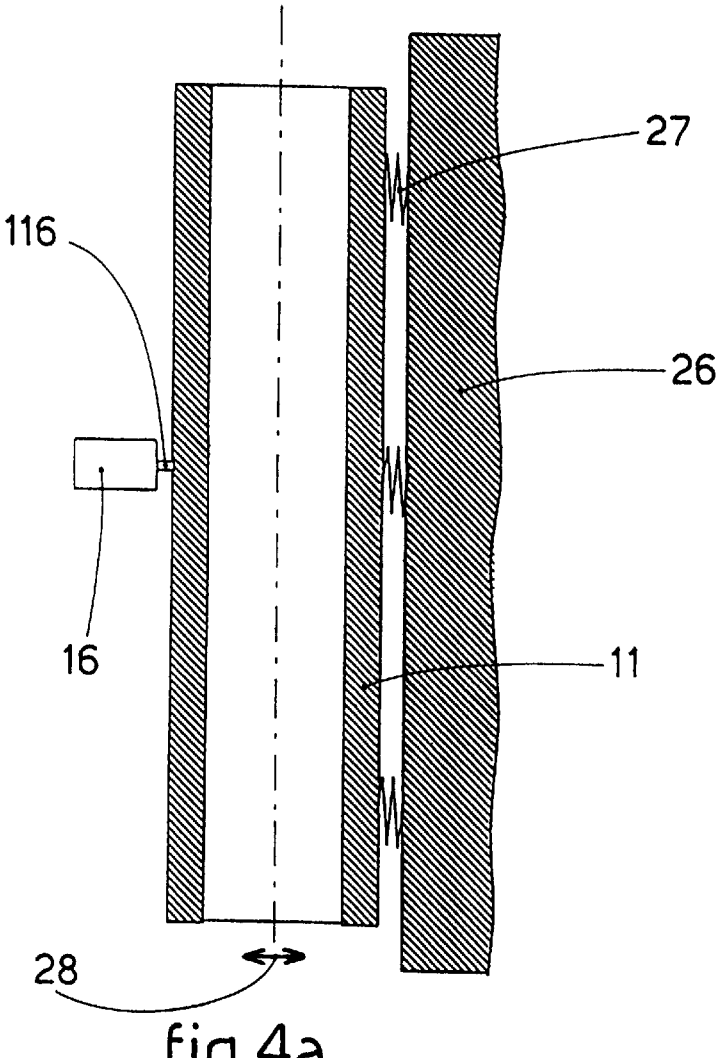

According to the embodiment shown diagrammatically in FIGS. 4*a* and 4*b*, the crystalliser 11 is constrained, on one or more sides, to the rigid support 26 of the ingot mould 10 by means of elastic supports 27.

These elastic supports 27, according to their arrangement, make it possible to move the crystallizer 11 in two directions, indicated by reference numbers 28 and 29 respectively in FIGS. 4*a* and 4*b*, transversely to the vertical and at right angles to the wall of the crystalliser 11 itself.

In this case, by exciting one or more magnetostrictive actuators 16, the crystalliser 11 is made to oscillate transversely like a rigid body, and moreover at least part of the stresses are discharged onto the elastic supports 27 and more generally onto the support system of the crystalliser 11.

Figure 5:
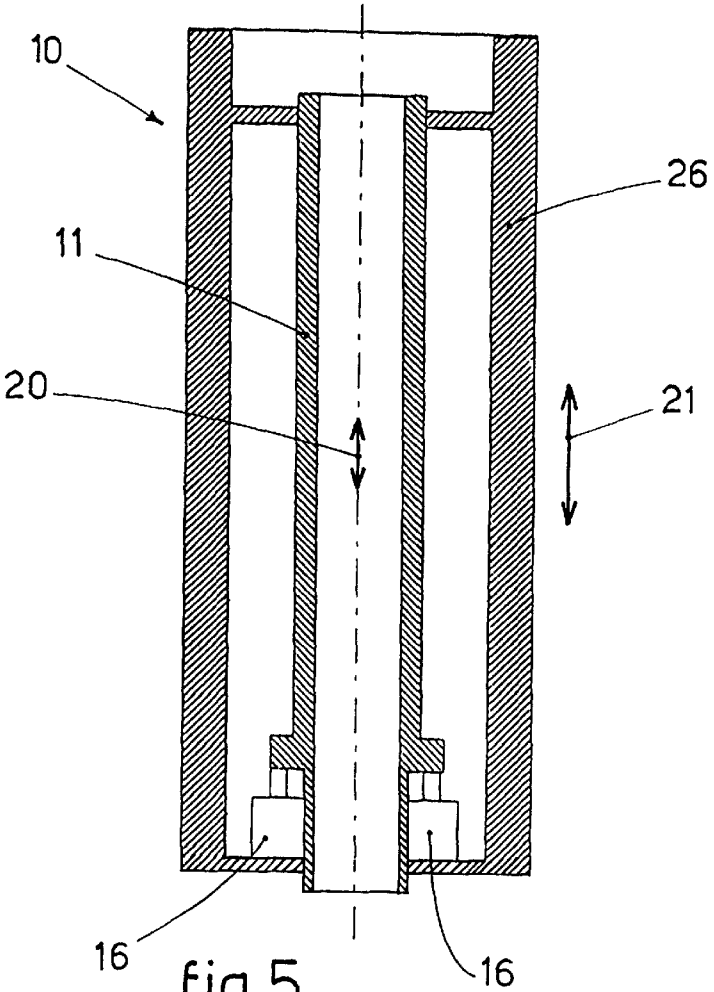
FIG. 5 shows a further variant of the invention.

According to the further embodiment shown in FIG. 5, the magnetostrictive actuators 16 are arranged vertically on the crystalliser 11, in this case in cooperation with its lower part and induce vertical oscillations on this base; these vertical oscillations, referenced by the number 20, are superimposed over the large amplitude, low frequency oscillations, referenced by the number 21, generated by the oscillation system of the ingot mould 10 which is known to the state of the art.

According to a variant, the actuators 16 are arranged to cooperate with the wall of the crystalliser 11 at a desired angle.

In this case, an overall system of vertical oscillation is obtained, which is generated by the magnetostrictive actuators 16 and which includes characteristics of small amplitude and high frequency and acceleration, modulated to a lower frequency by the system of vertical oscillation of the ingot mould 10.

We claim:

1. Method to obtain vibrations in the walls of a crystalliser of an ingot mould including a channel for the circulation of cooling liquid, comprising vertically oscillating the ingot mould with oscillations generated by a system of vertical oscillation, and inducing vibrations of small amplitude and high frequency and acceleration on the crystalliser by generating an electromagnetic field to excite an actuator comprising an element made of a magnetostrictive alloy arranged in cooperation with at least one face of the crystalliser.

2. Method as in claim 1, wherein the step of inducing vibrations comprises inducing transverse vibrations on the crystalliser by the magnetostrictive actuators which are arranged at right angles to the longitudinal axis of the crystalliser.

3. Method as in claim 1, wherein the step of inducing vibrations comprises inducing vertical vibrations on the crystalliser by the magnetostrictive actuators which are provided to act parallel to the longitudinal axis of the crystalliser.

4. Method as in claim 1, wherein the step of inducing vibrations comprises inducing vertical vibrations on the crystalliser, the vertical vibrations being generated by the magnetostrictive actuators which are provided to act at an angle with respect to the longitudinal axis of the crystalliser.

5. Method as in claim 1, wherein the step of inducing vibrations comprises inducing transverse vibrations by exploiting elastic properties of the crystalliser.

6. Method as in claim 5, wherein the magnetostrictive actuator is excited to induce in the crystalliser frequencies of vibration of the crystalliser itself.

7. Method as in claim 5, wherein the magnetostrictive actuator is excited to induce in the crystalliser different frequencies from, and not coherent with, vibration frequencies of the crystalliser itself.

8. Method as in claim 5, wherein the high frequency varies from about 0.1 to about 20 kHz and a maximum amplitude of the vibrations is about 0.20 mm.

9. Method as in claim 1, wherein the step of inducing vibrations comprises inducing transverse vibrations, and the method further comprises constraining the crystalliser to a support of the ingot mould by elastic means which allow the crystalliser to oscillate like a rigid body in one or the other of the two directions transverse to the vertical and at right angles to the wall of the crystalliser.

10. Method as in claim 9, wherein the high frequency varies from about 0.1 to about 20 kHz and a maximum amplitude of the vibrations is about 0.20 mm.

11. Method as in claim 1, wherein the step of inducing vibrations comprises inducing vertical vibrations by magnetostrictive actuators associated with a base of the crystalliser at a high frequency in a range between about 1 and about 20 kHz and limited amplitude of about 0.03 mm, and modulating the vibrations to low frequency by the first oscillations generated by the system of vertical oscillation of the ingot mould.

12. Device to obtain vibrations in walls of a crystalliser of an ingot mould including at least a channel for the circulation of cooling liquid defined between an intermediate wall and an outer face of the crystalliser, the ingot mould being associated with a vertical oscillation system, the device being provided in cooperation with at least one wall of the crystalliser and comprising at least one actuator comprising an element made of magnetostrictive alloy and means to generate a magnetic field acting on the element.

13. Device as in claim 12, wherein the at least one magnetostrictive actuator is arranged transversely with respect to the wall of the crystalliser.

14. Device as in claim 12, wherein the at least one magnetostrictive actuator is arranged parallel to the vertical axis of the crystalliser and cooperates with the crystalliser itself.

15. Device as in claim from 12 wherein the magnetostrictive actuator includes a pusher element coaxial to the magnetostrictive alloy element and arranged in contact with the wall of the crystalliser passing through an aperture made at least in the intermediate wall.

16. Device as in claim 12, wherein a plurality of magnetostrictive actuators are arranged at different heights along the crystalliser.

17. Device as in claim 12, wherein a plurality of magnetostrictive actuators are arranged at different positions on the periphery of the crystalliser.

18. An ingot mold, comprising a crystalliser, at least one channel for the circulation of cooling liquid around an outer face of the crystalliser, a vertical oscillation system for vertically oscillating the crystalliser, and an actuator for inducing vibrations of small amplitude and high frequency and acceleration on the crystalliser, the actuator being provided in cooperation with at least one wall of the crystalliser and comprising an element made of magnetostrictive alloy and means to generate a magnetic field acting on the element.

* * * * *